US010330438B2

(12) United States Patent
Schmidt

(10) Patent No.: US 10,330,438 B2
(45) Date of Patent: Jun. 25, 2019

(54) RIFLE SCOPE WITH ADJUSTING AID

(71) Applicant: Schmidt & Bender GmbH & Co. KG, Biebertal (DE)

(72) Inventor: Manuel Schmidt, Wetzlar (DE)

(73) Assignee: Schmidt & Bender GmbH & Co. KG, Biebertal (DE)

( * ) Notice: Subject to any disclaimer, the term of this patent is extended or adjusted under 35 U.S.C. 154(b) by 0 days.

(21) Appl. No.: 15/789,080

(22) Filed: Oct. 20, 2017

(65) Prior Publication Data

US 2018/0120060 A1 May 3, 2018

(30) Foreign Application Priority Data

Oct. 27, 2016 (DE) ..... 10 2016 120 602

(51) Int. Cl.
*F41G 1/38* (2006.01)

(52) U.S. Cl.
CPC ..... *F41G 1/38* (2013.01)

(58) Field of Classification Search
CPC ..... G02B 23/00; G02B 7/04; G02B 7/10
USPC ..... 42/122
See application file for complete search history.

(56) References Cited

U.S. PATENT DOCUMENTS

D308,982 S * 7/1990 Moore ..... D16/132
D313,607 S * 1/1991 Moore ..... D16/132
5,180,875 A * 1/1993 Berry, Jr. ..... F41G 1/38 359/422
5,276,554 A 1/1994 Nassivera
5,388,005 A * 2/1995 Wilson ..... F41G 1/38 359/422
5,521,757 A 5/1996 Olson
5,924,211 A * 7/1999 Wambold, Jr. ..... G02B 7/10 359/694
D417,679 S * 12/1999 Cross ..... D16/132
6,226,880 B1 * 5/2001 Pitre ..... F41G 1/38 42/120
D443,628 S * 6/2001 Koshibe ..... D16/132
D444,160 S * 6/2001 Koshibe ..... D16/132
D476,714 S * 7/2003 Meinzer ..... D22/109
7,246,461 B2 * 7/2007 Wooden ..... F41G 1/44 359/422
D600,546 S * 9/2009 Scilingo ..... D8/397
7,636,210 B1 * 12/2009 Liang ..... G03B 17/14 353/101
D619,192 S * 7/2010 Riley ..... D22/108
7,836,626 B2 * 11/2010 Shepherd ..... F41G 1/44 42/119
D667,521 S * 9/2012 Hoshi ..... D22/109
(Continued)

OTHER PUBLICATIONS

Amazon.com Breakaway Nylon Coaster Cat Tail. Oct. 2, 2014.

*Primary Examiner* — Joshua E Freeman
(74) *Attorney, Agent, or Firm* — Clark & Brody

(57) ABSTRACT

The invention concerns a rifle scope (1) with a housing (10), in which optical lenses (20, 21, 22, 23) are arranged along an optical path (OP), and with an adjusting wheel (11) for adjusting a function, wherein the adjusting wheel (11) is mounted so as to turn relative to the housing (10) about an axis of rotation (A), and wherein the adjusting wheel (11) has a first coupling means (13), on which an adjusting aid (30) which projects relative to the axis of rotation (A) radially about the outer circumference (12) of the adjusting wheel (11) is releasably secured to a second coupling means (31).

15 Claims, 2 Drawing Sheets

(56) References Cited

U.S. PATENT DOCUMENTS

| | | | | |
|---|---|---|---|---|
| D819,163 | S * | 5/2018 | Hoshi | D22/109 |
| 2012/0105951 | A1* | 5/2012 | Lim | F41G 1/38 359/422 |
| 2013/0180154 | A1* | 7/2013 | Ilacqua | F41G 1/38 42/119 |
| 2015/0205066 | A1 | 7/2015 | Gibson et al. | |
| 2017/0059847 | A1* | 3/2017 | Lim | G02B 23/145 |
| 2017/0241742 | A1* | 8/2017 | Davidson | F41G 1/38 |
| 2017/0351053 | A1* | 12/2017 | Shinano | G02B 7/09 |
| 2018/0087872 | A1* | 3/2018 | White | G02B 23/145 |

* cited by examiner

RIFLE SCOPE WITH ADJUSTING AID

FIELD OF THE INVENTION

The invention concerns a rifle scope with an adjusting aid.

BACKGROUND ART

Rifle scopes are used for hunting and in the military to sight weapons on targets at great distance. For this, they have a lens arrangement along an optical path inside a housing, by which a target object is magnified. In particular, the lens arrangement comprises at least one objective and one eyepiece. The objective is an optical collecting system for real optical imaging of the target object and the eyepiece is a lens system by which one can look into the lens arrangement with one eye.

An intermediate image projected by the objective in a first image plane at the objective side is magnified and projected into a second image plane at the eyepiece side. Large magnifications only allow limited fields of vision, which do not permit an overview of a larger image portion, especially at short range. In order to also effectively include these objects in the sight, there is a variable magnification, or so-called zoom, in the prior art.

Furthermore, the object sighted in the first image plane at the objective side is projected with side reversal and standing upside down, so that is must be rectified. Therefore, an inversion system inside the rifle scope is used for the rectification of the image. Oftentimes the inversion system also allows variable magnification, for which there is an axial independent and defined displacement of at least two optical lenses or lens groups. The optical lenses include simple lenses and cemented lenses, among others. In this way, an intermediate image created in the first image plane at the objective side is rectified and projected magnified into the second image plane at the eyepiece side, where it is viewed.

In addition, further lenses may be arranged in the rifle scope to correct various imaging errors, such as achromatic lenses to eliminate color errors. In order to sight a target, a sighting marker, for example a target marker such as crosshairs is arranged or projected into the first or second image plane.

To adjust the sighting marker, an adjustment mechanism protruding radially on the housing is generally used, such as an adjustment screw, which is turned by an adjusting wheel, an adjusting cap, or an adjusting ring, as in DE 32 08 814 A1 or DE 37 37 856 A1.

Among other things, it is important for the adjustment to be such that the aiming point and the point of impact coincide. Insofar as the target distances vary significantly, parallax-related deviations of the target image plane from the sighting plane may be troublesome. This can be eliminated with a parallax compensation. Traditionally, this is done by axial displacement of the objective lens. Furthermore, manufacturing tolerances and crosswind may result in sideways deviations which need to be corrected with an adjusting mechanism.

In order to adjust the sighting marker, therefore, at least two adjustment knobs with adjustment wheels are secured on the outside of the rifle scope, for example at 90 degrees circumferential spacing, which can also be called an adjustment cap provided they are closed at one end. A first and a second adjustment knob serve for the vertical and the horizontal adjustment.

Furthermore, in DE 297 207 37 U1 there is described a rifle scope with a tubular housing, in which an optical inversion system and a sighting marker are present in a middle tube, the sighting marker being mounted firmly in a mount on the double tube. By turning an adjusting wheel, whose axis of rotation runs coaxially with the optical axis of the rifle scope, the lenses of the inversion system can move forward and backward along the optical axis. The turning is done by means of an adjusting wheel, which is mounted able to turn about the optical axis on the housing. In particular, the adjusting wheel is situated at the side with the eyepiece.

Besides these corrections to the target sighting, the rifle scope may also have further functions. Thus, activatable illuminated sighting markers exist, which are more recognizable during darkness. In these designs, a portion of the sighting marker such as the point of impact or crosshairs may be illuminated in order to provide an increased contrast for the sighting marker, or a portion thereof, depending on the application. Sometimes, the sighting marker or other information is also reflected into the optical path, e.g., by a beam splitter. In order to activate such a lighting device, DE 297 20 737 U1 for example calls for an illumination adjustment mechanism such that a third adjustment knob with adjusting wheel is arranged on the rifle scope.

Furthermore, an adjustment may be required to focus the target object. Another adjustment option in the case of rifle scopes with image magnifiers or residual light amplifiers is an adjustment of the desired image magnification.

Most of the adjustment options, especially those with more than two adjustment possibilities, are done with adjustment wheels mounted and able to turn on the housing. To simplify the adjustment, reading scales are usually arranged on them. Moreover, the adjustment wheels usually have a surface structure on the circumferential surface to assist grasping. However, it is a drawback that the grasping with wet and cold hands is often difficult, the settings of the function often are unreadable without taking one's eyes off the target object, and quick setting changes cannot be done with precision.

Therefore, the problem which the invention proposes to solve is to provide a rifle scope in which the shooter is assisted in the adjusting of a function in that this adjustment can be activated precisely with respect to the function being adjusted if possible without making eye contact, and this can also be done comfortably in cold and wet weather. As much as possible, a flexible handling and an adaptation to the conditions of use should be achieved. A simple, technically durable, robust and economical design is likewise desirable.

SUMMARY OF THE INVENTION

The invention concerns a rifle scope with a housing, in which optical lenses are arranged along an optical path, and with an adjusting wheel for adjusting a function, wherein the adjusting wheel is mounted so as to turn relative to the housing about an axis of rotation, wherein the adjusting wheel has a first coupling means, on which an adjusting aid which projects relative to the axis of rotation radially about the outer circumference of the adjusting wheel is releasably secured to a second coupling means.

Such an adjusting aid forms a very palpable projection beyond the adjusting wheel. This is easily felt without making eye contact and can also be easily activated in cold and wet weather. At the same time, from the position of the adjusting aid one can very easily infer the rotational position of the adjusting wheel without making eye contact. If the adjusting aid is not necessary for certain uses, it can be detached from the adjusting wheel and the adjusting wheel can be used without the adjusting aid. The adjusting aid can also be offered as an optional accessory thanks to its detachability from the adjusting wheel, so that the rifle scope can be adapted individually to the customer's needs.

Typically, the housing is tubular and the optical lenses are mounted in the housing.

In nearly all applications of rifle scopes, a sighting marker is arranged along the optical path in the housing, such as a target marker, crosshairs, a lined plate or a device for graphical projection of the sighting marker into the optical path.

The adjusting wheel can be mounted to rotate on the housing. However, this can be done directly or indirectly through other add-on parts, such as axes of rotation which are mounted on the housing.

Typically for a rifle scope, some of the optical lenses form an objective in the area of an entry opening of the housing. Likewise typically, some of the optical lenses form an eyepiece in the area of an exit opening of the housing.

According to one optional embodiment, the adjusting wheel is ring-shaped, disk-shaped, or cap-shaped. Disk-shaped configurations can easily cover the region located beneath them. Cap shapes have a low weight, even with a rather tall construction, they cover the region located beneath them and form a cavity to accommodate other components. Ring-shaped configurations are especially suitable when other components or the beam path or optical path need to be led through the ring.

One special embodiment of the rifle scope calls for the optical path to run through the adjusting wheel and for the adjusting wheel to be mounted rotatably relative to the housing and about the optical path. In this way, the adjusting wheel can be arranged in a very space-saving manner on the housing. Especially suitable for this are ring-shaped configurations of the adjusting wheel. The adjusting wheel is preferably arranged on the housing at the side with the eyepiece. It can be easily reached here by the user.

Optionally, the optical path runs along an optical axis of the rifle scope. If the optical path runs in this case through the adjusting wheel, the axis of rotation and the optical axis can be oriented parallel and preferably coaxial to each other. However, the adjusting wheel with the adjusting aid is also suitable for configurations in which the entry side and the exit side have different optical axes which run either parallel or at an angle to each other.

According to a more particular embodiment, the first coupling means has at least two mounting positions arranged distributed about the circumference of the adjusting wheel, in which the adjusting aid can be secured on the first coupling means and is releasable with the second coupling means. In this way, the shooter is free to select the mounting position more comfortable to him.

In one variant of the rifle scope, the first coupling means has at least one groove and the second coupling means has at least one insertion element for inserting into the groove. In this way, on the one hand a stable connection can be created, and on the other hand grooves at the side with the adjusting wheel may have a pleasant haptic design also when the adjusting aid is removed.

According to one special embodiment, the groove is encircling around the adjusting wheel and the adjusting aid can preferably be secured releasably in the groove in any desired mounting position about the circumference of the adjusting wheel. In this way, the shooter can freely choose the mounting position.

According to another special embodiment, the first coupling means has at least two grooves, which are arranged distributed about the circumference of the adjusting wheel, while the adjusting aid can be secured releasably at the grooves preferably in at least two different mounting positions around the circumference of the adjusting wheel. Depending on the number of the grooves, as many different mounting positions can be realized. Furthermore, especially stable connections between the coupling means can be created.

Preferably, the grooves are evenly distributed about the circumference. In this way, defined mounting positions about the circumference can be provided for the shooter. Especially preferably, the number of grooves is between 4 and 64, preferably between 8 and 64, more preferably between 16 and 64, and especially preferably 32. Furthermore, for an equal choice of mounting options in each quadrant, a number of grooves corresponding to four or a multiple of four is advantageous.

An embodiment is advantageous in which the grooves are oriented parallel to each other. This facilitates the mounting of the adjusting aid. In particular, the grooves may be oriented substantially parallel to the optical path or the optical axis. Additionally, the grooves are preferably straight in configuration.

For a firm connection and simple configuration of the coupling means, it is preferable for the grooves to have the same cross section. A configuration is also advantageous in which the grooves are identical in construction. Besides their function as coupling means, such grooves can also as such constitute an easily gripped surface for the shooter.

In one special embodiment it is provided that each groove has respectively opposite groove flanks in cross section which are oriented at least approximately parallel to each other at their free end (in cross section). This facilitates the cleaning and at the same time clamping forces between the coupling means can be utilized for the fixation. Thus, the grooves should not have any undercut.

Another design option is for the grooves to be broader than the distance between two neighboring grooves. In this way, many mounting positions can be created.

Furthermore, in one embodiment it is provided that the grooves are each open at least at one end, preferably at both ends; in particular by a runout from the adjusting wheel. In this way, contaminants can be easily pushed out from the grooves. An easy cleaning is also assisted by an optional embodiment in which the grooves have a round groove bottom.

Good usage comfort is achieved when the adjusting wheel has a larger diameter than the housing in the area bordering on the adjusting wheel.

In order to also obtain visual information about the rotary position and the mounting position of the adjusting wheel, reading means are preferably arranged on the adjusting wheel and the housing for reading the function settings. For example, the reading means may be a scale and/or position marker (e.g., arrows, rulings and/or numbers).

According to another embodiment of the rifle scope, it is provided that the second coupling means has clamping means, with which the second coupling means can be fixedly clamped to the first coupling means. With clamping means, a firm force locking can be achieved between the adjusting wheel and the adjusting aid.

In one special variant, the insertion element is part of the clamping means, while the insertion element is arranged between two clamping jaws of the clamping means, and the insertion element is arranged in one groove and the two clamping jaws in two adjacent grooves and subjected to a clamping force in the direction of the insertion element. Thus, the two oppositely acting forces of the clamping jaws cancel each other out. The insertion element serves preferably as a supporting core. For this, the insertion element should lie against the groove flanks. In this way, in particular, two webs situated between the three grooves are each clamped between one of the clamping jaws and the insertion element. Webs can then be clamped between the grooves without a plastic deformation, even if they are very thin. Large clamping forces can be achieved in particular if the insertion element and/or the clamping jaw plates extend for a distance in the groove which is longer than the grooves are broad. Preferably, the ratio between this extension and the groove width is at least 2:1, more preferably 3:1 and especially preferably 4:1. A slender design can be achieved in particular by a plate-like basic shape of the insertion element and/or the clamping jaws. One design is advantageous in which the clamping jaws are joined to the insertion element by at least one axis of rotation, preferably by two axes of rotation. Alternatively, the clamping jaws can be connected to the insertion element by at least one solid hinge, preferably by two solid hinges.

Furthermore, an optional configuration is provided in which the clamping force is produced with one or more tightening screws. In this way, large clamping forces can be achieved, and the result is a firm connection between the coupling means. Such a tightening screw may pass for example through one of the two clamping jaws and the insertion element and be screwed into the second of the two clamping jaws.

One special design calls for the adjusting aid to have an activating lever. This preferably has a crescent-shaped curvature (e.g., a shark fin shape). In the third dimension, i.e., the crescent-shaped curvature lies in a plane subtended by the first and second dimension, such an activating lever may be rather flat. In this way, the differently curved and/or straight edges and surfaces of the activating lever enable an ergonomic activation, even in different positions of rotation of the adjusting wheel.

In order to suit personal preferences, one optional variant of the rifle scope calls for the adjusting aid to be secured to the first coupling means such that the tip of the crescent-shaped curvature optionally points in a first or a second direction, preferably in the direction of the optical path or contrary to the optical path. Thus, the shooter can choose between two orientations. Preferably, this is possible in every mounting position.

Furthermore, in another embodiment it is provided that the crescent-shaped curvature lies in the same plane as the axis of rotation. This is especially ergonomical.

Moreover, in one variant embodiment it is provided that the activating lever is rigidly connected to the insertion element. As a result, the adjusting aid can be designed very rigid and mountable on the adjusting wheel, so that a precise activation is possible. Single-piece designs of activating lever and insertion element also come under this.

Optionally, the adjustable function of the rifle scope belongs to the group of magnification selection, information display, illumination setting, crosswind correction, target distance correction, focus and image magnification setting. These technical functions can also be activated with the adjusting aid in multistage or continuously adjustable designs.

One special embodiment in particular calls for the adjustable function to be a magnification selection or a setting of the magnification of the rifle scope. It can be provided that the magnification selection can be produced by some of the optical lenses, while at least one of the optical lenses of this group is mounted so as to be movable along the optical path, and wherein the position of the optical lens along the optical path is dependent on the rotary position of the adjusting wheel about the axis of rotation. This enables, in particular, a fast and precise changing of the magnification, for example, in order to observe a target with high magnification and by switching to low magnification to keep the surroundings in view. Namely, with the adjusting aid it is very easy to set two different angle positions of the adjusting wheel, or at least to return quickly to one important position.

BRIEF DESCRIPTION OF THE DRAWINGS

Other features, details and advantages of the invention will emerge from the wording of the claims as well as the following description of sample embodiments with the aid of the drawings. There are shown:

DETAILED DESCRIPTION OF THE INVENTION

Figure 1:
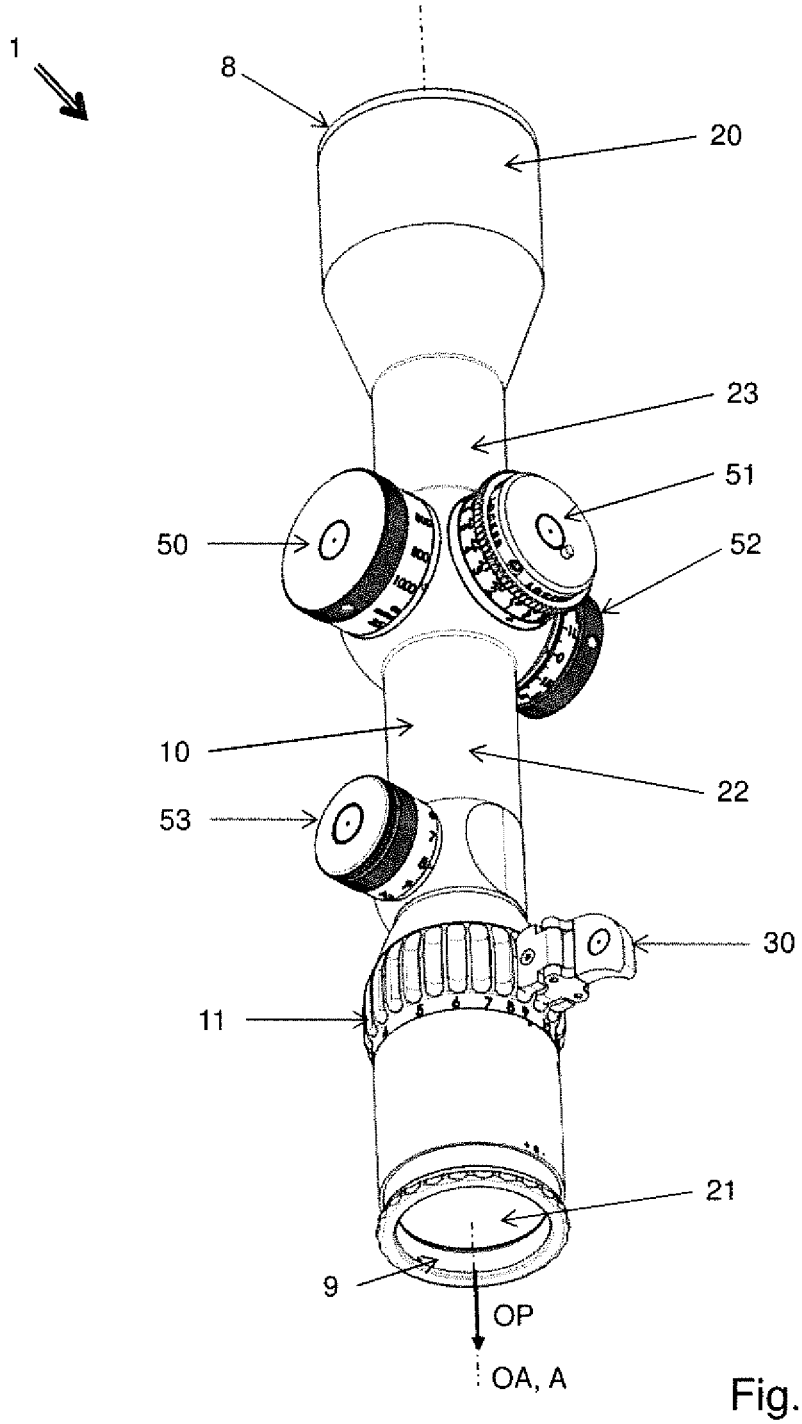
FIG. 1 a perspective view of a rifle scope with an adjusting aid on an adjusting wheel.

FIG. 1 shows a rifle scope 1 in a perspective view. This has a housing 10, in which optical lenses 20, 21, 22, 23 are arranged along an optical path OP. In particular, the housing 10 is tubular in design and the optical lenses 20, 21, 22, 23 are mounted in the housing 10. Some of the optical lenses 20 form an objective in the region of an entry opening 8 of the housing 10. Others of the optical lenses 21 form an eyepiece in the region of an exit opening 9 of the housing 10. In the middle portion of the tubular housing 10 there are arranged optical lenses 22, 23 which form an inversion system. With these lenses 22, 23, an optical magnification of a target object can also be carried out, since these optical lenses 22, 23 of the inversion system are each mounted movable along the optical path OP in the housing 10.

In the present case, the optical path OP and an optical axis OA of the rifle scope 1 outside of the latter are congruent or coaxial. Merely by adjustment functions of the rifle scope 1 can the optical path OP inside the housing 10 deviate slightly from the optical axis OA.

There is also arranged along the optical path OP in the housing 10 a sighting marker, such as a target marker, crosshairs, a ruled plate or a graphic projection. This sighting marker preferably lies in a first image plane between the objective and the inversion system or in a second image plane between the inversion system and the eyepiece.

Furthermore, the rifle scope 1 has an adjusting wheel 11 for adjusting a function. The adjusting wheel 11 is mounted on the housing 10 and able to turn relative to it about an axis of rotation A. In the present case, the optical axis OA and the axis of rotation A are oriented coaxial to each other.

The adjusting wheel 11 is ring-shaped, the optical path OP extending through the ring-shaped adjusting wheel 11, and the adjusting wheel 11 is mounted able to rotate relative to the housing 10 and about the optical path OP. It will be noticed that the adjusting wheel 11 is arranged at the side with the eyepiece on the housing 10. Furthermore, the adjusting wheel 11 has a greater diameter than the housing 10 in the region bordering on the adjusting wheel 11.

As emerges from FIG. 1, yet other adjusting wheels 50, 51, 52, 53 are arranged on the circumference of the housing 10 for the adjusting of various other functions. Three of these adjusting wheels 50, 51, 52 are situated in the middle region of the housing 10 adjoining each other at 90 degrees spacing on the circumference of the housing 10. One of the adjusting wheels 50 has the function of a parallax compensation, in order to furnish a sharp image to the user at known or unknown distance to the target object by undertaking the parallax compensation with a rotary movement of the adjusting wheel 50. The second of these adjusting wheels 51 serves as a vertical adjustment, with which it is possible to correct for a shot pattern deviation. By a rotary movement on the adjusting wheel 51 of the vertical adjustment, the shot pattern deviation can be corrected in the vertical axis. The third of these adjusting wheels 52 is a horizontal adjustment. With this, a sideways, or horizontal, shot pattern deviation is corrected by turning on the adjusting wheel 52.

The adjusting wheel 53 lies along the optical path OP between the other three adjusting wheels 50, 51, 52 and the adjusting wheel 11 whose axis of rotation A is oriented coaxially to the optical axis OA. It has the function of lighting up the sighting marker, which in the present case is designed to be illuminated, in defined brightness degrees: these degrees can be selected by a rotational movement in order to change the brightness or completely turn off the illumination. The axes of rotation of the four additional adjusting wheels 50, 51, 52, 53 are each time oriented transversely to the optical axis OA, especially perpendicular to it.

The positions of the optical lenses 22, 23 of the inversion system along the optical path OP are dependent on the rotary position of the adjusting wheel 11 about the axis of rotation A. For this, the adjusting wheel 11 and these optical lenses 22, 23 are mechanically interconnected by positioning means. This can be done, for example, by control cams in the housing and an internal tube connected firmly in rotation to the adjusting wheel 11. With the control cams, a guide pin and thus a lens 22, 23 secured to it can be moved.

In FIG. 1, moreover, one notes that an adjusting aid 30 is arranged on the adjusting wheel 11, which is coupled to the inversion system. Further details about this can be found in FIG. 2. The adjusting aid 30 extends distinctly radially beyond the outer circumference 12 of the adjusting wheel 11 relative to the axis of rotation A.

Figure 2:
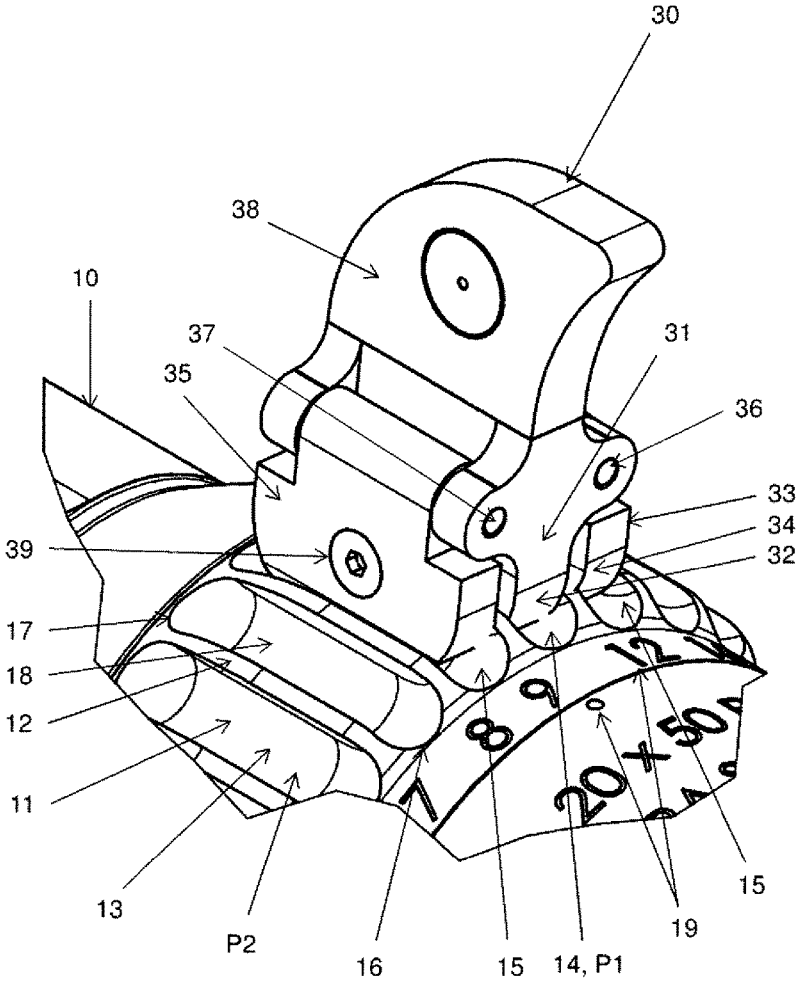
FIG. 2 a magnified view of a region of FIG. 1 in which the adjusting aid is situated.

In FIG. 2 one notices that the adjusting wheel 11, which is coupled to the inversion system, comprises or forms a first coupling means 13. The adjusting aid 30 is releasably secured by a corresponding second coupling means 31 to the first coupling means 13.

The first coupling means 13 forms 32 mounting positions P1, P2 arranged distributed about the circumference of the adjusting wheel 11, in which the adjusting aid 30 can be releasably secured by the second coupling means 31 to the first coupling means 13. For this, the first coupling means 13 has grooves 14, 15 and the second coupling means 31 an insertion element 32 for inserting into a selected one of the grooves 14. The grooves 14, 15 are arranged distributed about the circumference of the adjusting wheel 11 and the adjusting aid 30 can be releasably secured to the grooves 14, 15 in several different mounting positions P1, P2 about the circumference of the adjusting wheel 11. For this, the grooves 14, 15 are straight in configuration, arranged in an equal distribution about the circumference, oriented parallel to each other and parallel to the optical path OP or the optical axis OA, and identical in construction with the same cross section. In particular, each of the grooves 14, 15 has in cross section opposite groove flanks which are oriented at least approximately parallel to each other at their free end. Optionally, for example, between 4 and 64, preferably between 8 and 64, more preferably between 16 and 64, and especially preferably 32 grooves 14, 15 can be provided. Especially suitable are numbers which are a multiple of four. A large number of grooves 14, 15 increases the number of possible mounting positions P1, P2. In order to achieve a large number of grooves 14, 15, it is advisable to form the grooves 14, 15 broader in cross section than the distance between two adjacent grooves 14, 15. Moreover, the grooves 14, 15 are open at each of their two ends 16, 17, especially in that they run out to the side (in the direction of the axis of rotation A) from the adjusting wheel 11. Furthermore, the grooves 14, 15 have a round groove bottom 18, which can easily be cleaned and enables good stability of the adjusting wheel 11.

Moreover, reading means 19 are arranged on the adjusting wheel 11 and the housing 10 for reading the function settings.

Moreover, it emerges from FIG. 2 that the second coupling means 31 has clamping means 33, with which the second coupling means 31 can be fixedly clamped to the first coupling means 13. The insertion element 32 is part of these clamping means 33. For this, it is situated between two clamping jaws 34, 35, while the insertion element 32 is arranged in one groove 14 and the two clamping jaws 34, 35 in two neighboring grooves 15 and subjected to a clamping force in the direction of the insertion element 32. In this way, the two webs situated between the three grooves 14, 15 are each clamped between one of the clamping jaws 34, 35 and the insertion element 32. The clamping jaws 34, 35 and the insertion element 32 are more than four times as long as the grooves 14, 15 are wide. In particular, they have a flat plate-shaped form.

The clamping jaws 34, 35 are each joined by an axis of rotation 36, 37 to the insertion element 32 and the clamping force is produced with a tightening screw 39. This is passed through one of the two clamping jaws 35 and the insertion element 32 and screwed into the second of the two clamping jaws 36. Regardless of other features of the sample embodiment, such a tightening screw 39 should have a countersunk head, which is set into one of the two clamping jaws 35. Furthermore, the tightening screw 39 should only protrude into the other clamping jaw 36, but not emerge on the opposite side.

Moreover, the adjusting aid 30 has an activating lever 38 with a crescent-shaped curvature, which is rigidly joined to the insertion element 32 or forms a single piece with the insertion element 32. In particular, the activating lever 38 has a shark fin basic shape. The crescent-shaped curvature lies in a plane with the axis of rotation A, so that the tip of the crescent points in the present case in the direction of the eyepiece (see FIG. 1). The adjusting aid 30 and the coupling means 13, 31 however are designed so that the tip of the crescent-shaped curvature can also optionally point in the opposite direction. If needed, the adjusting aid 30 may also be completely dismounted. Nevertheless, the adjusting wheel 11 can still be activated then. Namely, the grooves 14, 15 also form a grip structure.

The invention is not confined to one of the above-described embodiments, but rather can be modified in many ways.

In particular, alternatively or also additionally, the further adjusting wheels 50, 51, 52, 53 could be outfitted with first coupling means, so that an adjusting aid could be releasably secured to them. The adjusting wheel instead of being ring-shaped can also be disk-shaped or cap-shaped. Accordingly, the adjustable function of the rifle scope which is assisted by an adjusting aid optionally comes from the group of magnification selection, information display, illumination setting, crosswind correction, target distance correction, focus and image magnification setting.

Another alternative may consist in that the groove or also two or three grooves encircle the adjusting wheel, i.e., they are ring-shaped. Then the adjusting aid can be releasably secured to the groove or grooves in any desired mounting position about the circumference of the adjusting wheel. Preferably, a grip structure is then provided on the webs between the grooves and alongside the grooves. The shooter then cannot so easily slip off when operating the adjusting wheel without the adjusting aid.

All of the features and advantages emerging from the claims, the description and the drawing, including design features, spatial arrangements, and method steps, can be essential to the invention either in themselves or also in the most diverse of combinations.

| List of reference numbers | |
|---|---|
| 1 | Rifle scope |
| 8 | Entry opening |
| 9 | Exit opening |
| 10 | Housing |
| 11 | Adjusting wheel |
| 12 | Outer circumference of adjusting wheel |
| 13 | First coupling means |
| 14 | Groove |
| 15 | Groove |
| 16 | End of groove |
| 17 | End of groove |
| 18 | Groove bottom |
| 19 | Reading means |
| 20 | Optical lens |
| 21 | Optical lens |
| 22 | Optical lens |
| 23 | Optical lens |
| 30 | Adjusting aid |
| 31 | Second coupling means |
| 32 | Insertion element |
| 33 | Clamping means |
| 34 | Clamping jaw |
| 35 | Clamping jaw |
| 36 | Axis of rotation |
| 37 | Axis of rotation |
| 38 | Activating lever |
| 39 | Tightening screw |
| 50 | Additional adjusting wheel |
| 51 | Additional adjusting wheel |
| 52 | Additional adjusting wheel |
| 53 | Additional adjusting wheel |
| A | Axis of rotation |
| OA | Optical axis |
| OP | Optical path |
| P1 | First mounting position |
| P2 | Second mounting position |

The invention claimed is:

1. A rifle scope (1) with a housing (10), in which optical lenses (20, 21, 22, 23) are arranged along an optical path (OP), and with an adjusting wheel (11) for adjusting a function, wherein the adjusting wheel (11) is mounted so as to turn relative to the housing (10) about an axis of rotation (A), characterized in that the adjusting wheel (11) has a first coupling means (13) having at least one groove (14), on which an adjusting aid (30) which projects relative to the axis of rotation (A) radially about the outer circumference (12) of the adjusting wheel (11) is releasably secured to a second coupling means (31) having at least one insertion element (32) for insertion into the at least one groove (14), wherein the second coupling means (31) has clamping means (33), with which the second coupling means (31) can be fixedly clamped to the first coupling means (13), wherein the insertion element (32) is part of the clamping means (33), while the insertion element (32) is arranged between two clamping jaws (34, 35), and the insertion element (32) is arranged in one groove (14) and the two clamping jaws (34, 35) are arranged in two adjacent grooves (15) and subjected to a clamping force in the direction of the insertion element (32).

2. The rifle scope (1) as claimed in claim 1, characterized in that the adjusting wheel (11) is ring-shaped, disk-shaped, or cap-shaped.

3. The rifle scope (1) as claimed in claim 1, characterized in that the optical path (OP) runs through the adjusting wheel (11) and the adjusting wheel (11) is mounted rotatably relative to the housing (10) and about the optical path (OP).

4. The rifle scope (1) as claimed in claim 1, characterized in that the first coupling means (13) has at least two mounting positions (P1, P2) arranged distributed about the circumference of the adjusting wheel (11), in which the adjusting aid (30) can be secured on the first coupling means (13) and is releasable with the second coupling means (31).

5. The rifle scope (1) as claimed in claim 1, characterized in that the groove (14) is encircling around the adjusting wheel (11) and the adjusting aid (30) can be secured releasably in the groove (14) in any desired mounting position (P1, P2) about the circumference of the adjusting wheel (11).

6. The rifle scope (1) as claimed in claim 1, characterized in that the first coupling means has at least two grooves (14, 15), which are arranged distributed about the circumference of the adjusting wheel (11), while the adjusting aid (30) can be secured releasably at the grooves (14, 15).

7. The rifle scope (1) as claimed in claim 1, characterized in that the clamping force is produced with a tightening screw (39).

8. The rifle scope (1) as claimed in claim 1, characterized in that the adjusting aid (30) has an activating lever (38).

9. The rifle scope (1) as claimed in claim 1, characterized in that the adjusting aid (30) has an activating lever (38) and the activating lever (38) is rigidly connected to the insertion element (32).

10. The rifle scope (1) as claimed in claim 1, characterized in that the adjustable function of the rifle scope (1) belongs to the group of magnification selection, information display, illumination setting, crosswind correction, target distance correction, focus and image magnification setting.

11. The rifle scope (1) as claimed in claim 1, characterized in that the adjustable function is a magnification selection of the rifle scope (1), wherein the magnification selection can be produced by some of the optical lenses (22, 23), while at least one of the optical lenses (22, 23) of this group is mounted so as to be movable along the optical path (OP), and wherein the position of the optical lens (22, 23) along the optical path (OP) is dependent on the rotary position of the adjusting wheel (11) about the axis of rotation (A).

12. The rifle scope (1) as claimed in claim 9, characterized in that the crescent-shaped curvature lies in the same plane as the axis of rotation (A).

13. The rifle scope (1) as claimed in claim 6, wherein the adjusting aid (30) is secured releasably at the grooves (14, 15) in at least two different mounting positions (P1, P2) around the circumference of the adjusting wheel (11).

14. The rifle scope (1) as claimed in claim 8, wherein activating lever (38) has a crescent-shaped curvature.

15. The rifle scope (1) as claimed in claim 14, characterized in that the crescent-shaped curvature lies in the same plane as the axis of rotation (A).

* * * * *